US005921053A

United States Patent [19]

Callahan et al.

[11] Patent Number: 5,921,053

[45] Date of Patent: Jul. 13, 1999

[54] INTERNALLY REINFORCED GIRDER WITH PIERCEABLE NONMETAL COMPONENTS

[75] Inventors: Robert M. Callahan, Blue Ridge; Ronald B. Shiflett, Goodview, both of Va.

[73] Assignee: Metwood, Inc., Troutville, Va.

[21] Appl. No.: 08/992,189

[22] Filed: Dec. 17, 1997

[51] Int. Cl.[6] ..... E04C 3/292

[52] U.S. Cl. ..... 52/731.2; 52/737.3; 52/376; 52/732.1; 52/737.6

[58] Field of Search ..... 52/731.2, 737.3, 52/376, 732.1, 737.6, 650.1, 731.3, 732.2, 732.3, 733.2, DIG. 8, 731.1, 730.1, 731.7; 29/897.34, 897.35

[56] References Cited

U.S. PATENT DOCUMENTS

| | | | |
|---|---|---|---|
| 320,079 | 6/1885 | Martin | 52/376 X |
| 1,075,845 | 10/1913 | Mills | 52/732.1 X |
| 1,740,053 | 12/1929 | Wehr | 52/731.2 |
| 2,738,832 | 3/1956 | Torkelson . | |
| 2,851,747 | 9/1958 | Rolen | 52/731.2 |
| 3,256,662 | 6/1966 | Powers | 52/731.2 X |
| 3,301,926 | 1/1967 | Reiland . | |
| 3,604,174 | 9/1971 | Nelson, Jr. | 52/601 |
| 3,791,912 | 2/1974 | Allard | 52/309.7 X |
| 5,609,006 | 3/1997 | Boyer | 52/731.9 |
| 5,625,997 | 5/1997 | Callahan et al. . | |
| 5,678,381 | 10/1997 | DenAdel | 52/730.1 |
| 5,713,176 | 2/1998 | Hunt | 52/731.5 |

FOREIGN PATENT DOCUMENTS

| | | | |
|---|---|---|---|
| 1271350 | 6/1968 | Germany | 52/732.1 |
| 111150 | 7/1944 | Sweden . | |
| 815213 | 3/1981 | U.S.S.R. . | |
| 1596036 | 9/1990 | U.S.S.R. . | |
| 469893 | 8/1937 | United Kingdom | 52/731.2 |

*Primary Examiner*—Carl D. Friedman
*Assistant Examiner*—Laura A. Callo
*Attorney, Agent, or Firm*—Stephen R. Greiner

[57] ABSTRACT

A girder including a pair of C-shaped members secured together so as to form a hollow box. A number of reinforcing rods are secured within the C-shaped members. The reinforcing rods extend the respective lengths of the C-shaped members and are positioned side-by-side. A pierceable block is secured to at least one end of the hollow box. A pair of pierceable stringers are secured to the top and bottom of the hollow box. The pierceable block and stringers permit the girder to be secured within a building structure with conventional fasteners such as nails, screws and staples.

17 Claims, 1 Drawing Sheet

INTERNALLY REINFORCED GIRDER WITH PIERCEABLE NONMETAL COMPONENTS

FIELD OF THE INVENTION

The present invention relates generally to static structures and, more particularly, to a girder, or header including pierceable nonmetal components for retaining penetrating fasteners.

BACKGROUND OF THE INVENTION

Home builders are confronted with significant challenges in offering high quality structures at competitive prices. Design trends as well as fluctuations in lumber and labor costs often prevent builders from obtaining a reasonable profit for their work. In response to marketplace uncertainties, steel-framed home construction is becoming popular.

Builders are attracted to the strength, termite resistance and dimensional stability of steel. Steel materials being used in modern residential construction are also relatively lightweight and easy to handle. Therefore, homes with larger open spaces, longer floor spans and higher walls are possible.

Homes constructed with steel frames have proven to be more durable than those framed with wood. In areas vulnerable to hurricanes or earthquakes, they are better able to withstand induced loads. Further, because steel is noncombustible, homes constructed from steel easily comply with local codes and fire regulations. Because it is termite-proof, pesticide treatments are also unnecessary. Thus, health experts recommend steel framing for chemically sensitive home buyers seeking the best possible interior air quality.

Most residential steel framing is assembled using the "stick-built" construction method. Stick-built construction utilizing steel components is similar to that involving wood. Layout and assembly are the same except for one crucial difference, steel components are joined together with screws rather than nails. Thus, some residential builders have been hesitant to utilize steel components because construction tends to proceed at a somewhat slower pace and the retraining of framing crews, accustomed conventional wood framing methods, is required. A need, therefore, exists for a high-strength, metallic girder which preserves the advantages of conventional wood framing methods when used.

SUMMARY OF THE INVENTION

A girder constructed in accordance with the present invention preferably features a pair of C-shaped, metallic members which are welded together so as to form a hollow box with a polygonal cross section. Reinforcing rods are respectively welded into each interior corner of the hollow box and extend the respective lengths of the C-shaped members. A pierceable block is secured to one or both of the opposed ends of the hollow box. A pair of pierceable stringers are secured to the top and bottom of the hollow box. The pierceable block and stringers permit the girder to be secured within a building structure with penetrating fasteners such as nails, screws and staples.

It is an object of the invention to provide improved elements and arrangements thereof in a girder with the features described which is inexpensive in manufacture, lightweight in construction, and fully dependable in use.

These and other objects, features and advantages of the present invention will become readily apparent upon further review of the following specification and drawings.

BRIEF DESCRIPTION OF THE DRAWINGS

The present invention may be more readily described with reference to the accompanying drawings, in which.

Similar reference characters denote corresponding features consistently throughout the accompanying drawings.

DETAILED DESCRIPTION OF THE PREFERRED EMBODIMENT

Figure 1:
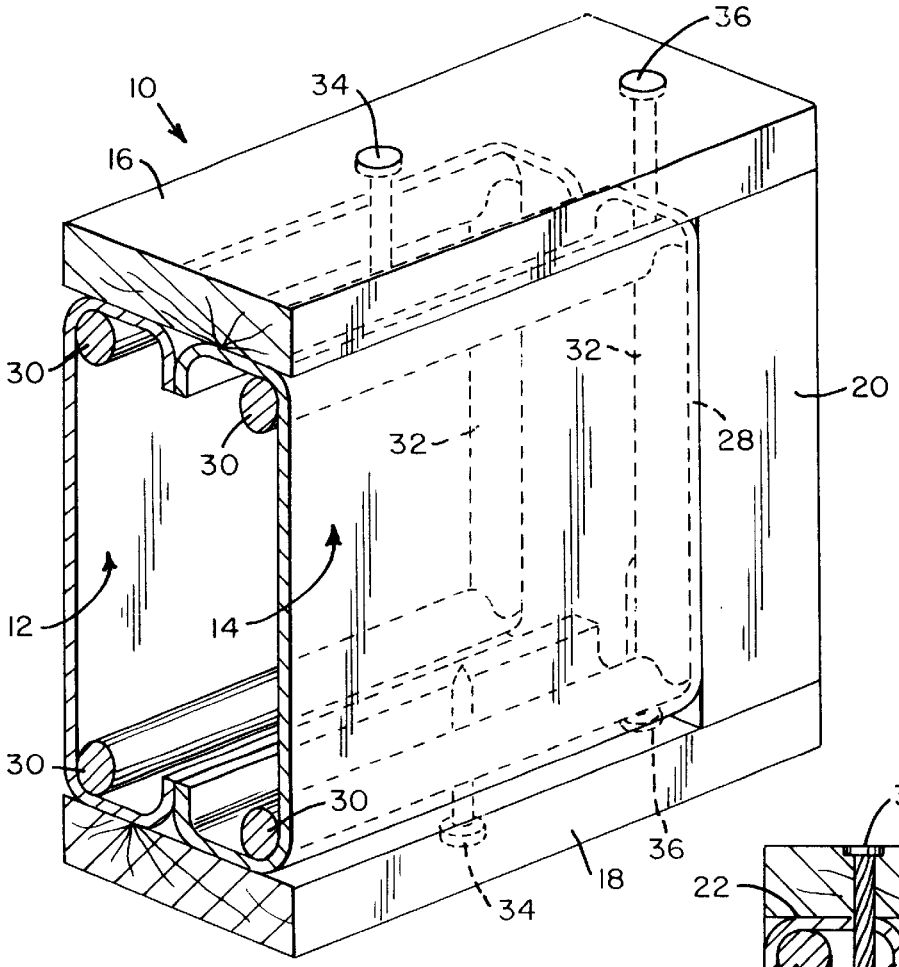
FIG. 1 is a perspective view of a girder in accordance with the present invention having portions broken away.
Figure 2:
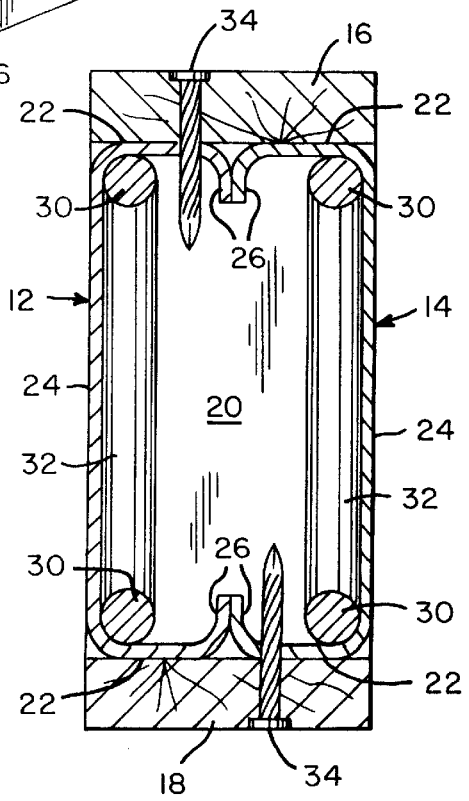
FIG. 2 is a lateral cross-sectional view of the girder of FIG. 1.

Referring now to the FIGS., a girder in accordance with the present invention is shown at 10. The girder 10 includes a pair of elongated members 12 and 14 joined together so as to form a hollow box. Secured to the top and bottom of the conjoined members 12 and 14 are pierceable stringers 16 and 18. Secured between the stringers 16 and 18 at one, or both, of the ends of the conjoined members 12 and 14 is a pierceable block 20.

Each of the members 12 and 14 is formed by bending a thin, rectangular strip of sheet metal into a C-shape. The members 12 and 14 both include a pair of opposed end walls 22 extending at right angles from an intermediate wall 24. Each of the members 12 and 14 also includes a pair of flanges 26 extending inwardly toward one another from the ends of the end walls 22 in a common plane parallel to the intermediate wall 24. The respective ends of the end walls 22, intermediate walls 24 and flanges 26 define a planar surface 28 oriented at right angles to the longitudinal axis of each of the members 12 and 14.

Each of the members 12 and 14 is reinforced for improved load-carrying characteristics in terms of compression, tension and torsion. Preferably, metallic, reinforcing rods or rebars 30 are welded into the corners where the intermediate wall 24 and end walls 22 of each of the members 12 and 14 meet. The rebars 30 extend the length of the members 12 and 14. At the ends of each of the members 12 and 14, a relatively short rebar 32 is welded to the intermediate wall 24 so as to connect the rebars 30 together to form a truss.

After welding the rebar-containing members 12 and 14 together along their flanges 26, the pierceable stringers 16 and 18 are secured to the top and bottom of the members 12 and 14 with nails 34 or other fasteners. As shown, the ends of the stringers 34 project slightly beyond the ends of the members 12 and 14. The pierceable block 20 is snugly positioned between the projecting ends of the stringers 16 and 18 and is secured therebetween by nails 36 driven laterally through the stringers.

Wood or like materials adapted to receive and retain therein the shaft of a nail, screw, staple or other penetrating fastener can be used to form the pierceable stringers 16 and 18 and block 20. Loads are transferred from the stringers 16 and 18 directly into the end walls 22 of the members 12 and 14. Loads imparted on the block 20, which is in abutment with the planar surface 28 as well as the rebars 30 and 32, are transferred into the members 12 and 14 and rebars 30 and 32.

From the foregoing, it should be apparent that the present invention provides the principal benefits of steel framing while preserving many of the advantages of conventional construction methods utilizing wood. It should be noted also that the girder provided by the present invention, being hollow, is lighter in weight than conventional wooden counterparts of similar load-bearing capability. Thus, with the present invention, building structures incorporating the latest architectural designs can be constructed with relative ease and minimal cost.

While the invention has been described with a high degree of particularity, it will be appreciated by those skilled in the art that modifications may be made thereto. For example, the stringers 16 and 18 may be deleted from either, or both, the top and bottom of the conjoined members 12 and 14. Also, stringers (not shown) may be secured to the intermediate walls 24 as well as the end walls 22 of the members 12 and 14 to allow a carpenter to drive penetrating fasteners anywhere into the surface of the girder. Therefore, it is to be understood that the present invention is not limited to the sole embodiment described above, but encompasses any and all embodiments within the scope of the following claims.

We claim:

1. A girder, comprising:

a first C-shaped member formed from sheet metal;

a second C-shaped member formed from sheet metal and welded to said first C-shaped member so as to form a hollow box with opposed ends;

a first pair of metallic reinforcing rods welded in a spaced apart relationship within said first C-shaped member, said first pair of metallic reinforcing rods extending the length of said first C-shaped member;

a second pair of metallic reinforcing rods welded in a spaced apart relationship within said second C-shaped member, said second pair of reinforcing rods extending the length of said second C-shaped member; and, a pierceable block secured to one of said opposed ends of said hollow box.

2. The girder according to claim 1 wherein said pierceable block is formed of wood.

3. The girder according to claim 1 further comprising a pair of pierceable stringers secured to the exterior of said hollow box, one of said pierceable stringers being secured to the top of said hollow box, and the other of said pierceable stringers being secured to the bottom of said hollow box.

4. The girder according to claim 3 wherein said pierceable stringers extend beyond one of said opposed ends of said hollow box and said pierceable block abuts, and is secured to, said pierceable stringers.

5. The girder according to claim 3 wherein each of said pierceable stringers is formed of wood.

6. A girder, comprising:

a first C-shaped member having a first intermediate wall with a first pair of opposed end walls extending therefrom at right angles;

a second C-shaped member having a second intermediate wall with a second pair of opposed end walls extending therefrom at right angles, said second pair of opposed end walls being secured to said first pair of opposed end walls so as to form a hollow box with opposed ends and a rectangular cross section;

a plurality of rebars secured within said first and second C-shaped members, each of said rebars being respectively positioned within one of the corners formed at the junctions of said first and second intermediate walls with said first and second pairs of opposed end walls; and, a pair of pierceable blocks each being respectively secured to one of said opposed ends of said hollow box.

7. The girder according to claim 6 wherein said first C-shaped member, said second C-shaped member, and said rebars are formed of metal.

8. The girder according to claim 7 wherein said pierceable blocks are formed of wood.

9. The girder according to claim 6 further comprising a pair of pierceable stringers, one of said pierceable stringers being secured to the top of said hollow box, and the other of said pierceable stringers being secured to the bottom of said hollow box.

10. The girder according to claim 9 wherein said pierceable block is secured to one of said opposed ends of said hollow box by said pierceable stringers.

11. The girder according to claim 9 wherein each of said pierceable stringers is formed of wood.

12. A girder, comprising:

a first C-shaped member including:

a first intermediate wall;

a first pair of end walls integral with said first intermediate wall and extending at right angles therefrom; and, a first pair of flanges integral with said first pair of end walls and extending at right angles therefrom in a common plane parallel to said first intermediate wall;

a first pair of reinforcement rods being respectively secured within said first C-shaped member at the junctions of said first pair of end walls with said first intermediate wall;

a second C-shaped member welded to said first C-shaped member so as to form a hollow box with opposed ends, said second C-shaped member including:

a second intermediate wall;

a second pair of end walls integral with said second intermediate wall and extending at right angles therefrom; and, a second pair of flanges integral with said second pair of end walls and extending at right angles therefrom in a common plane parallel to said second intermediate wall, said second pair of flanges being in abutment with said first pair of flanges;

a second pair of reinforcement rods being respectively secured within said second C-shaped member at the junctions of said second pair of end walls with said second intermediate wall;

a pair of pierceable blocks each being respectively secured to said ends of said hollow box.

13. The girder according to claim 12 wherein said first C-shaped member, said second C-shaped member, and said reinforcement rods are formed of metal.

14. The girder according to claim 12 wherein said pierceable blocks are formed of wood.

15. The girder according to claim 12 further comprising a pair of pierceable stringers, one of said pierceable stringers being secured to the top of said hollow box, and the other of said pierceable stringers being secured to the bottom of said hollow box.

16. The girder according to claim 15 wherein said pierceable stringers extend beyond said opposed ends of said hollow box and said pierceable blocks abut, and are secured to, said pierceable stringers.

17. The girder according to claim 15 wherein each of said pierceable stringers is formed of wood.

* * * * *